United States Patent [19]

Ishihara

[11] Patent Number: 4,921,754

[45] Date of Patent: May 1, 1990

[54] HIGH-DURABILITY PAVEMENT MARKING SHEET MATERIAL

[75] Inventor: Yuji Ishihara, Tochigi, Japan

[73] Assignee: Seibu Polymer Kasei Kabushiki Kaisha, Tokyo, Japan

[21] Appl. No.: 688,872

[22] Filed: Jan. 4, 1985

[30] Foreign Application Priority Data

Jan. 13, 1984 [JP] Japan ..... 59-3512

[51] Int. Cl.[5] ..... B32B 25/02; B32B 7/02; E01F 9/04

[52] U.S. Cl. ..... 428/325; 404/12; 428/216; 428/519; 428/520; 428/913

[58] Field of Search ..... 428/325, 519, 520, 216, 428/236, 913; 404/12, 13

[56] References Cited

U.S. PATENT DOCUMENTS

| | | | |
|---|---|---|---|
| 2,407,680 | 9/1946 | Palmquist et al. | 428/325 |
| 2,440,584 | 4/1948 | Heltzer et al. | 428/325 |
| 2,543,800 | 3/1951 | Palmquist et al. | 404/14 |
| 3,764,455 | 10/1973 | Lovell et al. | 428/425.6 |
| 3,785,719 | 1/1974 | Jonnes | 404/14 |
| 3,915,771 | 10/1975 | Gatzke et al. | 428/325 |
| 4,117,192 | 9/1978 | Jorgensen | 428/325 |
| 4,248,932 | 2/1981 | Tung et al. | 428/325 |
| 4,282,281 | 8/1981 | Ethen | 428/325 |
| 4,299,874 | 11/1981 | Jones et al. | 428/325 |
| 4,388,359 | 6/1983 | Ethen et al. | 428/143 |
| 4,876,141 | 10/1989 | Kobayashi et al. | 428/217 |

*Primary Examiner*—George F. Lesmes
*Assistant Examiner*—Christopher W. Brown
*Attorney, Agent, or Firm*—Koda & Androlia

[57] ABSTRACT

A pavement marking sheet material of an improved durability comprises a laminate of a base layer containing unvulcanized synthetic rubber as a main ingredient and a colored layer of unvulcanized synthetic rubber containing a coloring agent and glass microspheres dispersed over the suface of the colored layer. The lower portions of the microspheres are embedded in the base layer and the remaining surfaces of the microspheres and the surface of the laminate are covered integrally with a surface layer of a thin film consisting of a transparent and colorless synthetic resin. The glass microspheres are prevented from coming off by the cooperation between the three layers and wear of the sheet itself is substantially reduced.

3 Claims, 1 Drawing Sheet

HIGH-DURABILITY PAVEMENT MARKING SHEET MATERIAL

BACKGROUND OF THE INVENTION

This invention relates to a novel pavement marking sheet material of an improved durability.

Various sheet materials have heretofore been known as ones adhered to roadway for the pavement marking purpose.

One type of such sheet materials is of a construction in which a microsphere support layer of a thin film resin in which glass microspheres are partially embedded is adhered to the surface of a base layer. This type of sheet material is disclosed, for example, in the specifications of U.S. Pat. Nos. 4,248,932, 4,282,281, 4,299,874, 4,117,192, 2,440,584, 3,915,771 and 3,764,455. These sheet materials have two characteristic features common through all of these specifications: on is that the lower hemispheres of the microspheres are supported only by the support layer and they never reach the inside of the base layer. The other is that the upper hemispheres of the microspheres protruding above the support layer and performing the function of reflecting light are exposed to the air.

The above-mentioned first characteristic that the microspheres do not reach the inside of the base layer is an unavoidable result of the prior art method of manufacturing the sheet material according to which the microsphere support layer having the lower hemispheres of the microspheres embedded previously is separately made and this support layer is adhered to the base layer.

The second characteristic that the upper hemispheres of the microspheres are exposed to the air is also an unavoidable construction for supporting the microspheres only by the support layer containing the coloring agent.

Pavement marking sheet material must be colored in colors which are distinguishable for passers-by. Since the base layer of the sheet needs to be thicker than the support layer for imparting it with durability, the addition of a coloring agent to the base sheet entails larger consumption of the coloring agent and therefore is uneconomical. For this reason, a substantial amount of the coloring agent must be added to the support layer with a result that the support layer becomes opaque by the coloring.

If the glass microspheres are entirely embedded in this opaque support layer, the microspheres apparently will not be able to perform the necessary light reflecting function. Thus, the upper hemispheres of the glass microspheres are exposed to the air and no further consideration has been given to this question.

This construction, however, allows the glass microspheres dispersed on the surface of the sheet and partially embedded in the support layer to contact wheels of running traffic directly. Consequently, this construction inevitably has the tendency that the glass microspheres come off from the support layer.

Since the upper hemispheres of the microspheres must be substantially exposed for enabling the microspheres to perform the light reflecting function and the portions of the microspheres embedded in the support layer are relatively small the support layer naturally becomes thin with a result that the above described tendency cannot be sufficiently prevented no matter what excellent adhesive to the microspheres may be chosen as the material of the support layer.

One of the above listed prior arts teaches that in case the support layer is worn by contact with wheeled traffic and the microspheres thereby come off, other microspheres embedded in the base layer come to be exposed so that no serious problem will arise. It will not be desirable, however, that the glass microspheres on the surface readily come off from the support layer.

SUMMARY OF THE INVENTION

It is an object of the present invention to provide a pavement marking sheet material of a novel construction capable of eliminating the above described disadvantage of the prior art sheet materials.

The basic characteristic feature of the invention for achieving this object resides in that the pavement marking sheet material comprises a laminate of a base layer containing unvulcanized synthetic rubber as a main ingredient and a colored layer of unvulcanized synthetic rubber containing a coloring agent and glass microspheres dispersed over the surface of the colored layer of the laminate, the surfaces of the lower portions of the microspheres being embedded in the base layer of the laminate and the remaining surfaces of the glass microspheres and the surface of the laminate being covered integrally with a surface layer of a thin film consisting of a transparent and colorless synthetic resin.

According to the invention, the glass microspheres performing the light reflecting function on the surface of the pavement marking sheet are prevented from coming off by the cooperation between the three layers, i.e., the base layer, the colored layer and the surface layer and wear of the sheet itself is substantially reduced whereby a pavement marking sheet material of an improved durability is provided.

BRIEF DESCRIPTION OF THE DRAWING

In the accompanying drawing.

DESCRIPTION OF PREFERRED EMBODIMENTS

Figure 1:
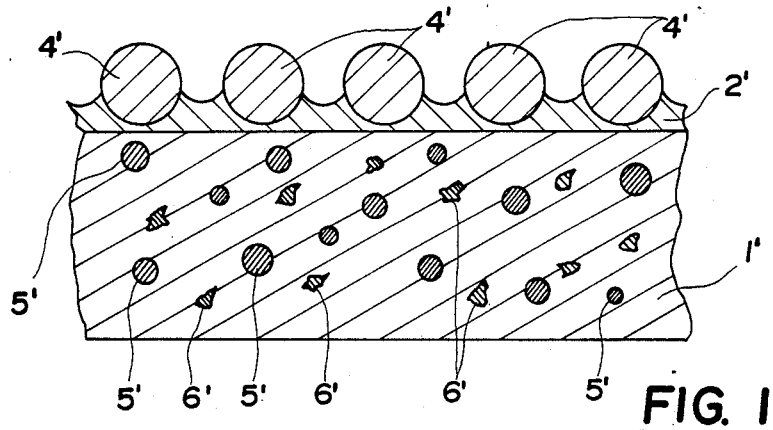
FIG. 1 PRIOR ART
FIG. 1 is a schematic vertical sectional view of an example of the prior art sheet materials and FIG. 2 is a schematic vertical sectional vie of the sheet material according to the present invention.

The prior art sheet material shown in FIG. 1 comprises a restorably deformable base layer 1' and an elastic and pigmented support layer 2' covering the upper surface of the base layer 1' and supporting glass microspheres 4' adhered thereto. The glass microspheres 4' are supported only by the support layer 2' with their upper surface being exposed to the air.

Figure 2:
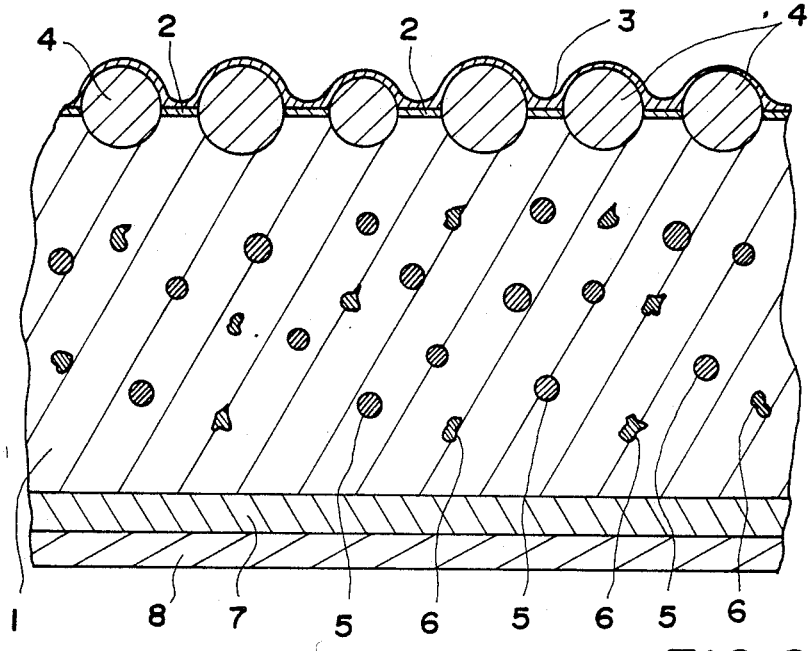

In comparison, in the sheet material according to the present invention shown in FIG. 2, parts of glass microspheres 4 are embedded in restorably deformable base layer 1 and colored layer 2 and the uppermost surfaces of the glass microspheres are covered with a transparent and colorless surface layer 3 having similar physical properties to the support layer 2' in the prior art sheet material a shown in FIG. 1.

In sum, the glass microspheres are supported only by the colored support layer and the upper surfaces of the glass microspheres are exposed to the air in the prior art sheet material whereas in the sheet material of the present invention, three layers, i.e., the restorably deformable base layer and colored layer and the transparent and thin surface layer, cooperate with one another to hold the glass microspheres and the glass microspheres are not exposed to the air directly but light is incident to the glass microspheres through the surface layer.

The base layer requires to be made of a material having excellent conformability to the irregular pavement surface, durability to various mechanical forces and capability of holding the glass microspheres. The base layer therefore comprises, as its main ingredient, unvulcanized rubber or synthetic rubber such, for example, as uncured isobutyleneisoprene rubber (IIR), chloroprene rubber (CR), acrylonitrilebutadiene rubber (NBR), chloro-sulphonyl-polyethylene or urethane rubber which has proper restorable deformability, tensile strength, wear resistance property and adhesion to glass. The base layer may comprise, if necessary, additives including a filler such as calcium carbonate powder, a pigment of a color matching the hue of the colored layer, wear resisting particles such as glass microspheres and a plasticizer. The mixture of these ingredients is formed into a sheet with a thickness of 1.0 mm–1.5 mm, preferably 1.2 mm–1.3 mm, by passing it through pressure rolls.

An adhesive layer of a suitable thickness is typically provided under the lower surface of the base layer. A release paper is attached to the under surface of the adhesive layer except in a case where the adhesive layer is made of a pressure sensitive solvent active adhesive.

The thin colored layer upon the base layer has characteristics similar to those of the base layer as described above. The colored layer is required to be adhered closely and integrally to the base layer and also colored in a desired color used for pavement marking. For these reasons, the color layer is made of an unvulcanized synthetic rubber which is the same as, or is different from but has the same properties as, the unvulcanized synthetic rubber used in the base layer added with a suitable coloring agent. Its coating thickness preferably is about 20–25 μm.

The surface layer can be made of a material which is transparent and colorless so that the microspheres can be exposed to light, has sufficient strength against the mechanical force applied to the pavement, has excellent durability and good adhesion to the glass microspheres and the colored layer. Useful materials are acrylic copolymers, vinyl chloride copolymers, cellulose, acetate-butylate, nitrocellulose, polyvinyl alcohol, polyurethane, polyethylene telephthalate (PET) and other polymers. The average thickness of the surface layer preferably is about 10–15 μm but the surface layer is less thick than the average thickness in the vicinity of the top of each microsphere.

The glass microspheres which are exposed to light through the surface of the sheet preferably are of a diameter of 180 μm–420 μm (250 μm in average) and of refractive index of above 1.60. The glass microspheres added in the base layer with the filler and other additives are sufficient if they are 70 μm to 90 μm in average diameter.

For making the sheet material of the present invention, the unvulcanized synthetic rubber material which is an ingredient of the base layer is added with desired amounts of the filler, glass microspheres, proper plasticizer, coloring agent and other materials. The mixture is blended and is formed into a sheet of a suitable thickness of 1 mm–1.5 mm through calender rolls and is wound into a roll. If necessary, this roll is unwound to coat the under surface thereof with an adhesive and then is wound into a roll again, with a release paper if necessary.

The base layer thus wound into a roll is then unwound while a liquid mixture prepared by dissolving the unvulcanized synthetic rubber material into a solvent and adding thereto a coloring agent giving a desired color is coated on the upper surface side of the unwound base sheet in such an amount that a desired thickness is provided to the coated layer after drying. Glass microspheres are dispersed uniformly over a wet surface of the coated layer in an amount of 80–120 g/m$^2$ of the coated layer. The glass microspheres are then pressed by rolls and the sheet is dried in a state in which about half of each glass microsphere is embedded in the sheet. Thereafter, a liquid coating prepared by adding a solvent to the surface layer forming material such as thermosetting acrylic copolymer or polyurethane is coated in such an amount that a desired average thickness is obtained after drying. The sheeting is dried and wound into a roll to provide a finished product.

The main ingredients and fillers of the base layer and support layer need not be of the same composition so long as they have good adhesion to each other. Their thickness and mixing ratios, diameter and amount of the glass microspheres and type and amount of the coloring agent may be designed suitably depending upon purpose of use of the product. The base layer and the colored layer may contain, besides the partially embedded glass microspheres, other inorganic particles.

Examples of the invention will now be described.

EXAMPLE 1

In this example, chloro-sulphonyl-polyethylene is used as the main ingredient in both the base layer and the colored layer.

The composition of the base layer is shown in Table 1 and its thickness is 1.2 mm. Tensile strength (kg/cm$^2$) of the base layer both in the longitudinal direction and the transverse direction measured by the JIS K 6301 tensile strength test, stretching rate (%) of the base layer measured by the JIS K 6301 tensile test and result of hardness test made by the JIS K 6301 spring hardness are shown in Table 2.

The formed base layer is once wound and then unwound while the colored layer material of a composition of Table 3 employing titania as the pigment is coated on the base sheet. Then, glass microspheres having average diameter of 250 μm and refractive index of 1.5 or over are dispersed over the coated layer in an amount of 100 g/m$^2$ to form a monolayer. Light pressure is applied to the glass microspheres through pressure rolls so that the glass microspheres are embedded through the colored layer and into the base layer by a depth of about 70 μm from the surface of the colored layer. The sheet is dried and wound. Then, as the sheet is unwound, a mixed solution of a thermosetting acrylic copolymer and cellulose-acetate-butylate of a composition shown in Table 4 is coated on the surfaces of the colored layer and the exposed glass microspheres in such an amount that an average thickness of the surface layer after drying will become 15 μm. The sheet is dried and wound into a roll to provide a finished product.

As regards this Example 1, a wear resistance test according to JIS K 5665 was conducted. Measurements were made employing a taper type abraser stipulated by JIS K 6902 2.9.1. and abrasing paper No. AA180 stipulated by JIS R 6252 for measuring amounts of wear with respect to the half-finished product and finished product according to Example 1, i.e., three test pieces each for ① a sheet in which glass microspheres are merely dispersed over the base layer, ② sheet obtained by passing the sheet of ① through pressure rolls and ③ finished product in which the sheet of ② has been covered by the surface layer. For obtaining comparison data, the same test was conducted with respect to the commercially available sheet material of the construction shown in FIG. 1.

Results of these tests are listed in Table 5.

EXAMPLE 2

A base layer with a thickness of 1.5 mm containing, as its main ingredient, a mixture of acrylonitrile butadiene rubber, butadiene rubber and chloro-sulphonyl-polyethylene is employed. As the colored layer, a layer with a thickness of 25 μm containing, as its main ingredient, chloro- sulphonyl-polyethylene is employed. The surface layer is made of a mixture of polyurethane and vinyl chloride copolymer. The composition of the base layer is shown in Table 1, physical properties obtained in Table 2, the composition of the colored layer forming coating material in Table 3, the surface layer forming coating material in Table 4 and result of measuring loss of weight by wear in Table 5, respectively.

EXAMPLE 3

A base layer with a thickness of about 1.2 mm containing, as its main ingredient, a mixture of acrylonitrile butadiene rubber, butadiene rubber and vinyl chloride is employed. As the colored layer, a layer with a thickness of 25 μm containing, as its main ingredient, chlorosulphonyl-polyethylene added with chrome yellow as the pigment is employed. The surface layer is made of a material with an average thickness of 15 μm which contains the same ingredients as Example 1 but differs in the mixing ratio.

The compositions of the respective layers and results of measurements are shown in Tables 1–5.

EXAMPLE 4

A base layer with a thickness of about 1.5 mm containing, as its main ingredient, a mixture of isobutyleneisoprene rubber and butadiene rubber, a colored layer with an average thickness of about 20 μm containing, as its main ingredient, isobutylene-isoprene rubber added with titanium dioxide as the pigment and a surface layer with a thickness of 20 μm composed of thermosetting acrylic copolymer and nitrocellulose are respectively employed.

The compositions of the respective layers and results of measurements are shown in Tables 1–5.

TABLE 1

| | Composition of base layer | | | | | | | |
|---|---|---|---|---|---|---|---|---|
| | Example 1 (parts by weight) | | Example 2 | | Example 3 | | Example 4 | |
| base layer | chloro-sulphonyl-polyethylene | 80 | NBR | 70 | NBR | 45 | IIR | 80 |
| | BR | 20 | BR | 10 | | 5 | BR | 20 |
| | plasticizer | 20 | chloro-sulphonyl-polyethylene | 10 | NBR + PVC | 50 | anti-aging agent | 2 |
| | filler | 270 | | 270 | | 270 | | 280 |
| | stearic acid | | | 1.5 | | 1.5 | | 1.5 |
| | glass micro-spheres | 150 | | 150 | | 200 | | 150 |
| | coloring agent | 15 | | 15 | | 20 | | 15 |

TABLE 2

| | Physical properties of base layer | | | | |
|---|---|---|---|---|---|
| | | Example 1 | Example 2 | Example 3 | Example 4 |
| base layer | tensile strength (kg/cm²) | | | | |
| | vertical | 64.2 | 40.6 | 34.0 | 19.0 |
| | transverse | 26.8 | 27.6 | 27.0 | 19.8 |
| | stretching (%) | | | | |
| | vertical | 166.0 | 68.0 | 130.0 | 62.0 |
| | transverse | 508.0 | 123.0 | 292.0 | 81.0 |
| | hardness | 80 | 75 | 78 | 82 |

TABLE 3

| | Composition of colored layer | | | | | | | |
|---|---|---|---|---|---|---|---|---|
| | Example 1 (parts by weight) | | Example 2 | | Example 3 | | Example 4 | |
| colored layer | chloro-sulphonyl-polyethylene | 100 | CSPE | 100 | CSPE | 100 | IIR | 100 |
| | pigment | 150 | | 150 | | 200 | | 150 |
| | solvent | 500 | | 500 | | 500 | | 500 |
| | triol | | | | | | | |

TABLE 4

| | Composition of surface layer | | | | | | | |
|---|---|---|---|---|---|---|---|---|
| | Example 1 (parts by weight) | | Example 2 | | Example 3 | | Example 4 | |
| surface layer | acrylic copolymer | 100 | polyurethane | 100 | acrylic copolymer | 100 | | 100 |
| | cellulose-acetate-butylate | 50 | polyvinyl-chloride copolymer | 50 | cellulose-acetate-butylate | 100 | nitrocellulose | 40 |
| | cross-linking agent | 10 | | 10 | | 10 | | 10 |
| | solvent triol | 500 | | 100 | | 700 | | 200 |
| | | | acetic ester | 100 | | | | |

Examples of various compositions are possible in addition to the above listed examples. It has been found, however, that the sheet material in which acrylonitrile butadiene rubber is used as the main ingredient of a white colored layer tends to become yellowish as compared with Examples 2 to 4.

As described in the foregoing, the characteristic feature of the present invention resides in the construction in which the glass microspheres performing the light reflecting function on the surface of the pavement marking sheet are prevented from coming off by the cooperation between the three layers, i.e., the base layer containing unvulcanized synthetic rubber as the main ingredient in which substantially lower halves of the glass microspheres are embedded, the colored layer containing, as the base layer, unvulcanized synthetic rubber as the main ingredient and the surface layer composed of a transparent resin and covering the upper surfaces of the colored layer and glass microspheres.

As a result, as will be apparent from the following Table 5, a sheet material is obtained in which coming off of the glass microspheres and amount of wear of the sheet itself are reduced or at least equal as compared with the prior art sheet materials.

TABLE 5

| | Results of measuring loss of weight by wear | | | | |
|---|---|---|---|---|---|
| | loss of weight by wear (mg) | | | | |
| | Example 4 | 1 | 2 | 3 | Example of commercially available sheet of FIG. 1 |
| state in which microshperes are merely dispersed on base layer | 310 | 274 | 285 | 281 | |
| state in which the sheet has been passed through pressure rolls after dispersion of microspheres | 172 | 145 | 160 | 154 | |
| state in which surface layer has been coated | 95 | 68 | 65 | 73 | 99 |

What is claimed is:

1. A high-durability pavement marking sheet material comprising a laminate of a base layer containing unvulcanized synthetic rubber as a main ingredient and a colored layer of unvulcanized synthetic rubber containing a coloring agent and glass microspheres dispersed over the surface of the colored layer of the laminate, the surfaces of the lower portions of the microspheres being embedded in the base layer of the laminate and the remaining surfaces of the glass microspheres and the surface of the laminate being covered integrally with a surface layer of a thin film consisting of a transparent and colorless synthetic resin.

2. A pavement marking sheet material as defined in claim 1 wherein said base layer is of a thickness of 1.0 mm–1.5 mm, said colored layer is of a thickness of about 20 μm–25 μm, and said surface layer is of an average thickness of about 10 μm–15 μm.

3. A high-durability pavement marking sheet material according to claim 1, wherein said synthetic rubber has good conformability to irregular pavement surfaces, good durability to various mechanical forces and can hold glass microspheres.

* * * * *